United States Patent [19]

George et al.

[11] Patent Number: 4,966,316

[45] Date of Patent: Oct. 30, 1990

[54] SHOE HORN AND CANE APPARATUS

[76] Inventors: Curtis L. George; Sandra L. George, both of P.O. Box 1421, Safety Harbor, Fla. 34695

[21] Appl. No.: 459,201

[22] Filed: Dec. 29, 1989

[51] Int. Cl.[5] ..... A47G 25/82; A45B 1/00; A45B 3/00; A45B 9/02

[52] U.S. Cl. ..... 223/119; 223/118; 223/113; 223/11; 135/66

[58] Field of Search ..... 223/118, 119, 111, 113; 135/66, 82, 77, 78

[56] References Cited

U.S. PATENT DOCUMENTS

| | | | |
|---|---|---|---|
| 470,109 | 1/1892 | Dickinson | 223/119 |
| 594,894 | 12/1897 | Nylander | 223/118 |
| 703,310 | 6/1902 | Schneider | 223/119 |
| 2,667,885 | 2/1954 | Pret | 135/66 |
| 3,591,226 | 6/1971 | Elmore | 223/119 |
| 4,709,839 | 12/1987 | Tucker | 223/119 |

*Primary Examiner*—Werner H. Schroeder
*Assistant Examiner*—Bibhu Mohanty
*Attorney, Agent, or Firm*—Leon Gilden

[57] ABSTRACT

An apparatus includes a handle orthogonally mounted to a longitudinally aligned shaft threadedly receiving a shoe horn or cane tip to a lower terminal end thereof. A first link with a second link integrally mounted at an acute angle thereto is pivotally mounted to a third link. The third link is pivotally mounted at its lowermost end to a generally "V" shaped fifth link maintained exteriorly of the longitudinal body by a fourth link, wherein the fifth link is pivotally mounted at its apex to the fourth link. A free terminal end of the fifth link includes a resilient shoe secured thereto to effect a clamping action between the associated shoe horn and the shoe. The apparatus further includes a hollow handle including a cap threadedly securable thereto defining a cavity therewithin to selectively receive and store the cane tip or shoe horn attachment therewithin prior to use.

5 Claims, 4 Drawing Sheets

SHOE HORN AND CANE APPARATUS

BACKGROUND OF THE INVENTION

1. Field of the Invention

The field of invention relates to shoe horn apparatus, and more particularly pertains to a new and improved shoe horn and cane apparatus wherein the same enables securement of a shoe remotely from an individual by clampingly engaging the shoe to enable insertion of an individual's foot therewithin.

2. Description of the Prior Art

Shoe horn organizations to enable remote securement of shoes relative to individuals of impaired physical abilities is known in the prior art. The instant invention enables remote securement of a shoe minimizing a need and effort to manually grasp the shoe enabling insertion of an individual's foot therewithin. Examples of the prior art include U.S. Pat. No. 3,591,226 to Elmore wherein a gripping device includes an elongate tube formed with a handle at one end and a shoe horn at the other, with a pivot alarm pivotal between the shoe horn in a first position and spaced from the shoe horn in a second position operative through a cable directed through the tube.

U.S. Pat. No. 4,709,839 to Tucker sets forth a shoe grasping device provided with an elongate tube mounted with a pivotal handle formed with a cable therethrough to effect a pinching action between a shoe horn and an associated spring-biased clip member secured to a remote terminal end of the tube.

U.S. Pat. No. 470,109 to Dickinson utilizes a shoe horn with a spring-biased resilient clip mounted to a rear surface of the shoe horn to secure an individual's shoe therebetween.

U.S. Pat. No. 703,310 to Schneider provides a shoe horn formed with a link member mounted rearwardly of the shoe horn, wherein the link member is provided with a forward roughened face cooperative with a rear surface of the shoe horn to grasp a shoe therebetween to secure the same for securement to an individual's foot.

As such, it may be appreciated that there is a continuing need for a new and improved shoe horn and cane apparatus wherein the same provides a remotely operative shoe horn for use by individuals requiring the use of a cane to provide a convenient and effective shoe horn arrangement.

SUMMARY OF THE INVENTION

In view of the foregoing disadvantages inherent in the known types of shoe horn apparatus now present in the prior art, the present invention provides a shoe horn and cane apparatus wherein the same provides an organization enabling a conversion from a remotely operative shoe horn to a cane including storage means for the accessory members utilized by the organization. As such, the general purpose of the present invention, which will be described subsequently in greater detail, is to provide a new and improved shoe horn and cane apparatus which has all the advantages of the prior art shoe horn apparatus and none of the disadvantages.

To attain this, the present invention sets forth an apparatus including a handle orthogonally mounted to a longitudinally aligned shaft threadedly receiving a shoe horn or cane tip to a lower terminal end thereof. A first link with a second link integrally mounted at an acute angle thereto is pivotally mounted to a third link. The third link is privotally mounted at its lowermost end to a generally "V" shaped fifth link maintained exteriorly of the longitudinal body by a fourth link, wherein the fifth link is pivotally mounted at its apex to the fourth link. A free terminal end of the fifth link includes a resilient shoe secured thereto to effect a clamping action between the associated shoe horn and the shoe.

The apparatus further includes a hollow handle including a cap threadedly securable thereto defining a cavity therewithin to selectively receive and store the cane tip or shoe horn attachment therewithin prior to use.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved shoe horn and cane apparatus which has all the advantages of the prior art shoe horn apparatus and none of the disadvantages.

It is another object of the present invention to provide a new and improved shoe horn and cane apparatus which may be easily and efficiently manufactured and marketed.

It is a further object of the present invention to provide a new and improved shoe horn and cane apparatus which is of a durable and reliable construction.

An even further object of the present invention is to provide a new and improved shoe horn and cane apparatus which is susceptible of a low cost of manufacture with regard to both materials and labor, and which accordingly is then susceptible of low prices of sale to the consuming public, thereby making such shoe horn and cane apparatus economically available to the buying public.

Still yet another object of the present invention is to provide a new and improved shoe horn and cane apparatus which provides in the apparatuses and methods of the prior art some of the advantages thereof, while simultaneously overcoming some of the disadvantages normally associated therewith.

Still another object of the present invention is to provide a new and improved shoe horn and cane apparatus wherein the same provides an organization convertible from a cane to a shoe horn in a convenient and accessible manner.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 2:
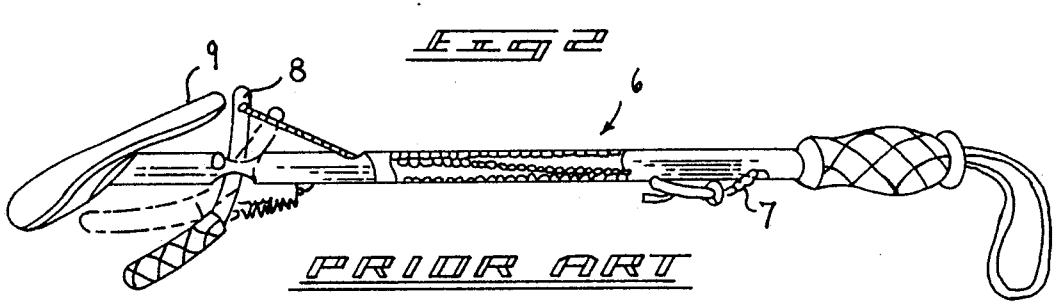
FIG 2 PRIOR ART
FIG. 2 is an orthographic view, partially in section, of a further prior art remotely operative shoe horn device.

With reference now to the drawings, and in particular to FIGS. 1 to 8 thereof, a new and improved shoe horn and cane apparatus embodying the principles and concepts of the present invention and generally designated by the reference numeral 10 will be described.

Figure 1:
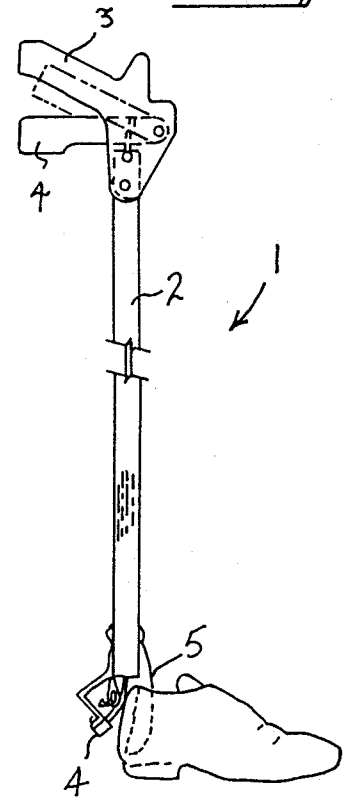
FIG 1 PRIOR ART
FIG. 1 is an orthographic view taken in elevation of a prior art remotely operative shoe horn device.
Figure 3:
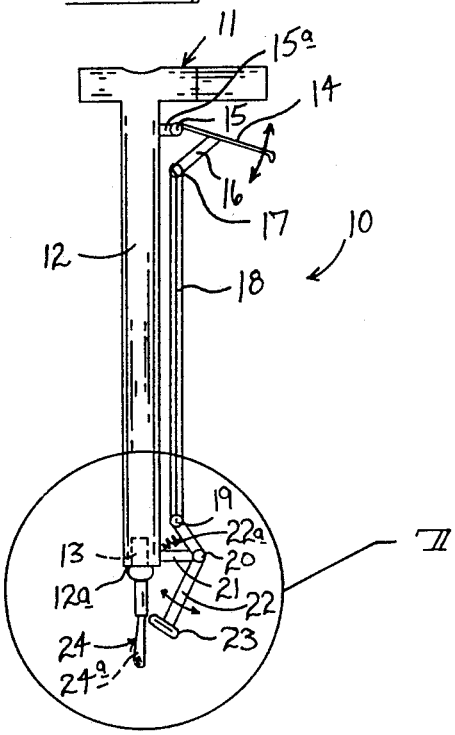
FIG. 3 is an orthographic view taken in elevation of the instant invention.

FIG. 1 is illustrative of a typical prior art shoe horn device 1 provided with an elongate tube 2 formed with a fixed handle 3 and a lever handle 4 provided with a cable directed through the tube cooperative to reposition a resilient pod 4 in contact with a rear surface of a shoe in cooperation with a shoe horn 5. FIG. 2 is a further example of a prior art device 6, wherein a cable 7 directed through the tube pivotally mounts an arcuate lever cooperative with a rear surface of a shoe horn 9 to grasp a shoe portion therebetween.

Figure 6:
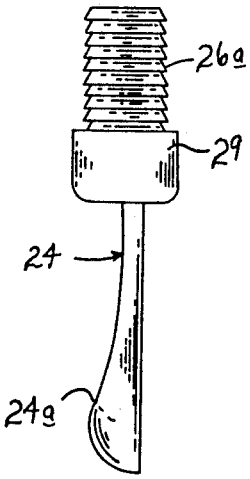
FIG. 6 is an orthographic view taken in elevation of the replaceable shoe horn utilized by the instant invention.
Figure 7:
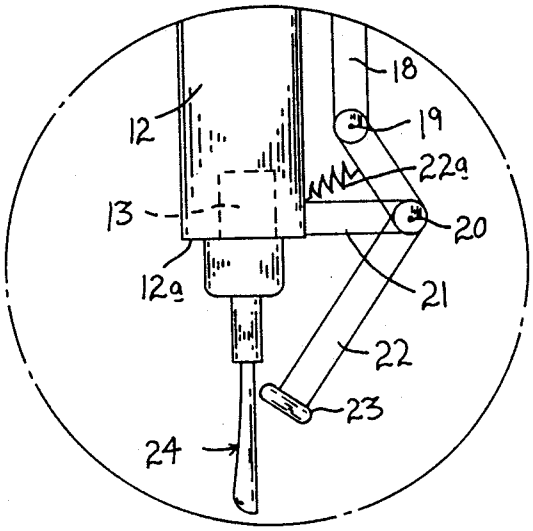
FIG. 7 is an orthographic enlarged view of Section 7 of FIG. 3.

More specifically, the shoe horn and cane apparatus 10 of the instant invention essentially comprises an elongate handle 11 of generally tubular construction formed with an elongate longitudinally aligned shaft 12 orthogonally mounted to the handle, wherein the shaft 12 includes a threaded socket 13 formed within a lower terminal end of the shaft remote from the handle 11. A first link 14 operative as a trigger is formed with a first pivot 15 at a rear terminal end thereof, wherein the first pivot 15 is positioned at a forward terminal end of a boss member **15*a* orthogonally mounted relative to a side surface of the shaft 12. The first link 15 includes a second link 16 integrally secured at an acute angle relative to the first link 14 and directed rearwardly thereof towards the first pivot 15. A third link 18 is longitudinally aligned and parallel relative to the shaft 12 and includes a second pivot 17 mounting the third link 18 to the second link 16 at an upper end of the third link 18, with a third pivot 19 mounting a lower end of the third link 18 to a fifth "V" shaped link 22. The "V" shaped link 22 is pivotally mounted to a fourth link 21 at an apex of the "V" shaped link and a forward terminal end of the fourth link 21, wherein the fourth link 21 is spaced from and parallel to the boss member 15*a*, wherein the fourth link 21 is positioned adjacent the lower terminal end of the shaft 12. A resilient shoe member 23 is mounted to the forward free end of the fifth "V" shaped link 22 and is of a generally enlarged configuration relative to the cross-section of the fifth link 22 to enhance engagement with an associated shoe horn attachment 24. The shoe horn attachment 24 is formed with a convex cavity 24*a* as the shoe 23 is cooperative with a rear surface of the shoe horn attachment 24. Reference to FIG. 6 illustrates the shoe horn attachment 24 formed with a boss member defining a central body 29 including a shoe horn and threaded stud 26 extending coaxially of the body 29 receivable within the threaded socket 13**.

Figure 4:
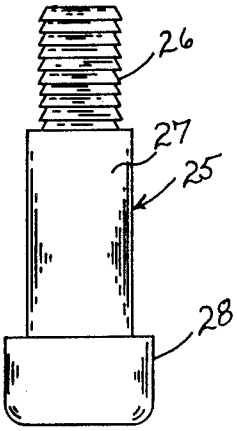
FIG. 4 is an orthographic view taken in elevation of the removable cane tip utilized by the instant invention.
Figure 5:
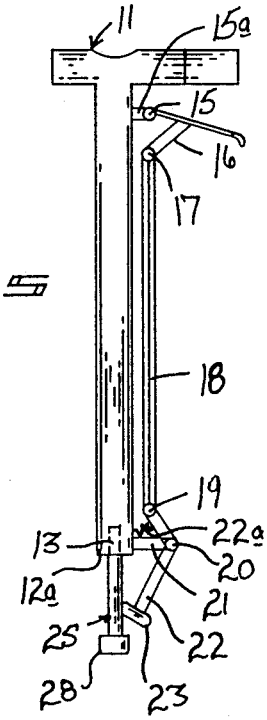
FIG. 5 is an orthographic view taken in elevation of the instant invention utilizing the cane tip mounted thereto.
Figure 8:
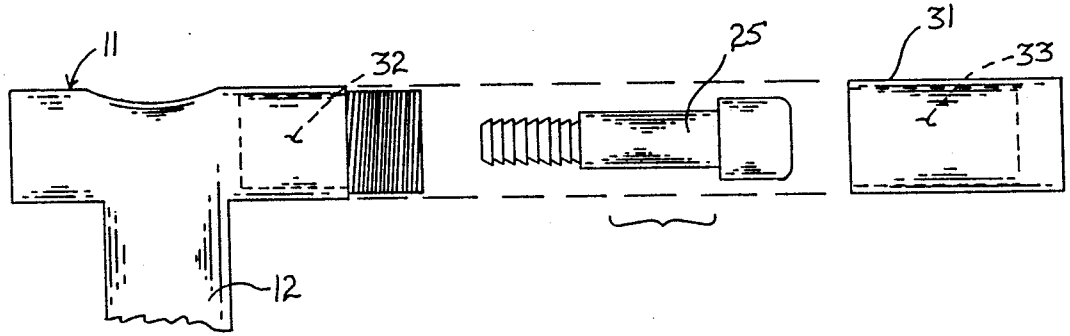
FIG. 8 is an isometric illustration, somewhat exploded, illustrating the various components of the handle, their configuration, and relationship.

FIG. 4 is illustrative of the cane tip attachment 25 formed with a threaded cane stud member 26 coaxially aligned with a cylindrical body 27, wherein a resilient tip 28 extends coaxially and forwardly of a lower terminal end of the body 27. FIG. 8 is illustrative of the handle 11 formed with a handle cavity 32 and a threaded exterior surface receiving a cap member 31 thereon, wherein the cap member 31 is formed with an internally threaded cap cavity 33 receivable onto the threaded handle portion to provide temporary storage for the illustrated cane tip attachment 25. Alternatively when the cane tip attachment 25 is utilized, the shoe horn attachment 24 is stored within the handle cavity 32 and the cap cavity 33. In use, retraction of the first link 14 against a bottom surface of the handle 11 forces the resilient shoe 23 into engagement with a rear surface of the shoe horn attachment 24. A return spring **22*a* biases the resilient shoe 23 in an extended position relative to a rear surface of the shoe horn attachment 24**.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A shoe horn and cane apparatus comprising, in combination, a handle member, and an elongate shaft including an upper end integrally mounted to the handle, and the shaft including a lower end including a securement portion formed in the interior of said shaft, and an elongate cane tip and an elongate shoe horn each selectively securable to the securement portion, and a link means cooperative with the handle for pivotment of a lower terminal end of the link means below the securement portion, and an engagement member mounted to the lower terminal end of the link means for cooperation with a rear surface of the shoe horn.

2. An apparatus as set forth in claim 1 wherein the securement portion comprises an internally threaded socket, and the shoe horn includes an elongate body with a threaded shaft threadedly receivable within the threaded socket, and the cane tip includes an elongate cane body formed with a lower resilient tip coaxially formed to the cane body, and a threaded stud member directed upwardly of the body remotely from the resilient tip coaxially aligned with the body and selectively receivable within the threaded socket.

3. An apparatus as set forth in claim 2 wherein the handle member is defined by a generally cylindrical body and includes a cap member threadedly securable and removable relative to the handle member and coaxially aligned therewith, the cap including an internally threaded cap cavity cooperative with a threaded shank coaxially aligned with the handle member and including a handle cavity defined interiorly of and rearwardly of the threaded shank, the cap cavity and the handle cavity defining an axial length greater than or equal to that defined by a predetermined length defined by the shoe horn, and a further predetermined length defined by the cane tip to enable selective securement of the cane tip or the shoe horn within the cap cavity and the handle cavity.

4. An apparatus as set forth in claim 3 wherein the link means includes a first link pivotally mounted to a first pivot, the first pivot formed at a forward end of a boss member, the boss member integrally and orthogonally mounted to a side surface of the shaft, the first link spaced from and underlying the handle member, and a second link integrally formed to the first link at an acute angle thereto, with the second link including a second pivot at a lower terminal end thereof spaced from the first link, and a third link including an upper end mounted to the second pivot, and a lower end mounted to a fourth pivot, the fourth pivot pivotally securing a fifth link thereto, the fifth link spaced from the shaft by a fourth link member, the fourth link member orthogonally secured to the shaft and aligned and spaced parallel to the boss member.

5. An apparatus as set forth in claim 4 wherein the fifth link is of a generally "V" shaped configuration including a fourth pivot formed at an apex of the "V" shaped configuration, the fourth pivot mounted at a forward terminal end of the fourth link, and the engagement member mounted to a free terminal end end of the "V" shaped fifth link spaced from the fourth pivot, and the engagement member mounted below the lower terminal end of the shaft for cooperation with the rib surface of the shoe horn.

* * * * *